US008020562B2

(12) United States Patent
Navarrette, Jr.

(10) Patent No.: US 8,020,562 B2
(45) Date of Patent: Sep. 20, 2011

(54) COMBINATION CHIN PROTECTOR AND MOUTH GUARD

(76) Inventor: Felipe E. Navarrette, Jr., Hobbs, NM (US)

( * ) Notice: Subject to any disclaimer, the term of this patent is extended or adjusted under 35 U.S.C. 154(b) by 0 days.

(21) Appl. No.: 12/662,781

(22) Filed: May 3, 2010

(65) Prior Publication Data

US 2010/0212674 A1 Aug. 26, 2010

Related U.S. Application Data

(63) Continuation-in-part of application No. 12/081,841, filed on Apr. 22, 2008, now abandoned.

(51) Int. Cl.
*A61C 5/14* (2006.01)
*A42B 1/24* (2006.01)

(52) U.S. Cl. ..... 128/861; 128/857; 128/859; 2/410; 2/422; 433/6

(58) Field of Classification Search ..... 128/857, 128/859, 861, 862; 2/410, 421, 422, 424, 2/425, 9; 433/6
See application file for complete search history.

(56) References Cited

U.S. PATENT DOCUMENTS

| | | | |
|---|---|---|---|
| 2,250,275 | A | 7/1941 | Riddell |
| 2,589,504 | A | 3/1952 | Miller |
| 2,847,003 | A | 8/1958 | Helmer et al. |
| 3,411,501 | A | 11/1968 | Greenberg |
| 3,485,242 | A | 12/1969 | Greenberg |
| 4,689,836 | A | 9/1987 | Vitaloni |
| 5,293,880 | A | 3/1994 | Levitt |
| 5,515,843 | A | 5/1996 | Chang |
| 5,794,274 | A | 8/1998 | Kraemer |
| 6,279,168 | B1 | 8/2001 | Bean |
| 6,499,147 | B2 | 12/2002 | Schiebl et al. |
| 2004/0163161 | A1 | 8/2004 | Morrow et al. |
| 2005/0102737 | A1 | 5/2005 | Worthing |

*Primary Examiner* — Patricia M Bianco
*Assistant Examiner* — Keri J Nelson
(74) *Attorney, Agent, or Firm* — Richard C. Litman

(57) ABSTRACT

The combination chin protector and mouth guard provides a device for protecting both the user's teeth and chin. The device is particularly adapted for use in combination with a motorcycle or motocross helmet, for example. The combination chin protector and mouth guard includes a chin protector having opposed front and rear faces, and a mouth guard, adapted for insertion into the mouth of the user, having a front face adapted for positioning against the lips of the user and at least one substantially U-shaped recess being formed in the mouth guard to receive and protect the user's teeth. A support having opposed upper and lower ends is further provided, the upper end thereof being attached to the mouth guard, and the lower end thereof being secured to the chin protector in order to tether the mouth guard to the chin protector.

7 Claims, 6 Drawing Sheets

COMBINATION CHIN PROTECTOR AND MOUTH GUARD

CROSS-REFERENCE TO RELATED APPLICATION

This application is a continuation-in-part of U.S. patent application Ser. No. 12/081,841, filed on Apr. 22, 2008 now abandoned.

BACKGROUND OF THE INVENTION

1. Field of the Invention

The present invention relates to safety equipment, and particularly to a combination chin protector and mouth guard than can be used, for example, during sports activities, such as motocross, freestyle motocross, bicycle motocross, freestyle bicycle motocross, mountain biking, snowmobile racing, four wheel drive vehicle racing or quad racing.

2. Description of the Related Art

Motocross is a form of motorcycle sport or all-terrain vehicle racing held on enclosed off-road circuits. Motocross tracks are often quite large and incorporate natural terrain features with varying quantities of man-made jumps and other features which test the drivers' abilities. Due to the nature of the sport, injury is not uncommon in motocross racing and numerous types of protective gear are used to protect the drivers. Sporting activities such as motocross, freestyle motocross, bicycle motocross, freestyle bicycle motocross, mountain biking, snowmobile racing, four wheel drive vehicle racing or quad racing, for example, can cause riders to be launched into the air between 50 and 200 feet above the ground. Such activities, which include racing and jumping, are well known to cause injuries to those involved, especially injuries to the unprotected teeth and chins of the riders.

Both chin protectors and mouth guards (typically used separately) are common in the field of motorcross, in particular. Chin protectors are typically formed from plastic or similarly rugged materials and cover the user's chin. The chin protector provides protection for the user's chin and lower jaw from blows and strikes, such as an accidental blow from the handlebars of the motocross bike. It should be noted that chin protectors are typically individual items, used separately from full-face protective helmets. Similarly, the mouth guard protects the user's teeth and tongue from accidental blows and strikes, such as those which may occur from accidental blows from the handlebars. These protective devices are typically provided separately from one another, thus allowing one or both to easily be lost or separated from one another. It would be desirable to provide a unitary device that offers both chin and mouth protection. Thus, a combination chin protector and mouth guard solving the aforementioned problems is desired.

SUMMARY OF THE INVENTION

The combination chin protector and mouth guard provides a device for protecting both the user's teeth and chin. The device is particularly adapted for use in combination with a motorcycle or motocross helmet, for example. The combination chin protector and mouth guard includes a chin protector having opposed front and rear faces, the rear face being concave and being contoured to receive and protect the chin of the user. A mouth guard, adapted for insertion into the mouth of the user, is further provided. The mouth guard has a front face adapted for positioning against the lips of the user and at least one substantially U-shaped recess formed in the mouth guard to receive and protect the user's teeth.

A support having opposed upper and lower ends is further provided, the upper end thereof being secured to the mouth guard, and the lower end thereof being secured to the chin protector in order to tether the mouth guard to the chin protector. The upper end of the support is secured to the front face of the mouth guard and the lower end is secured to the front face of the chin protector. The support is preferably formed from a flexible material, such as flexible plastic.

The combination chin protector and mouth guard further includes a strap having opposed upper and lower ends, the upper end of the strap being secured to the front face of the chin protector. The strap is adapted for securing at least one helmet chin strap to the chin protector. A releasable fastener for releasably securing the upper end of the strap to the lower end thereof is further provided in order to form a loop in the strap so that the helmet chin strap may be received within the loop. The releasable fastener may be a hook and loop fastener or the like.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
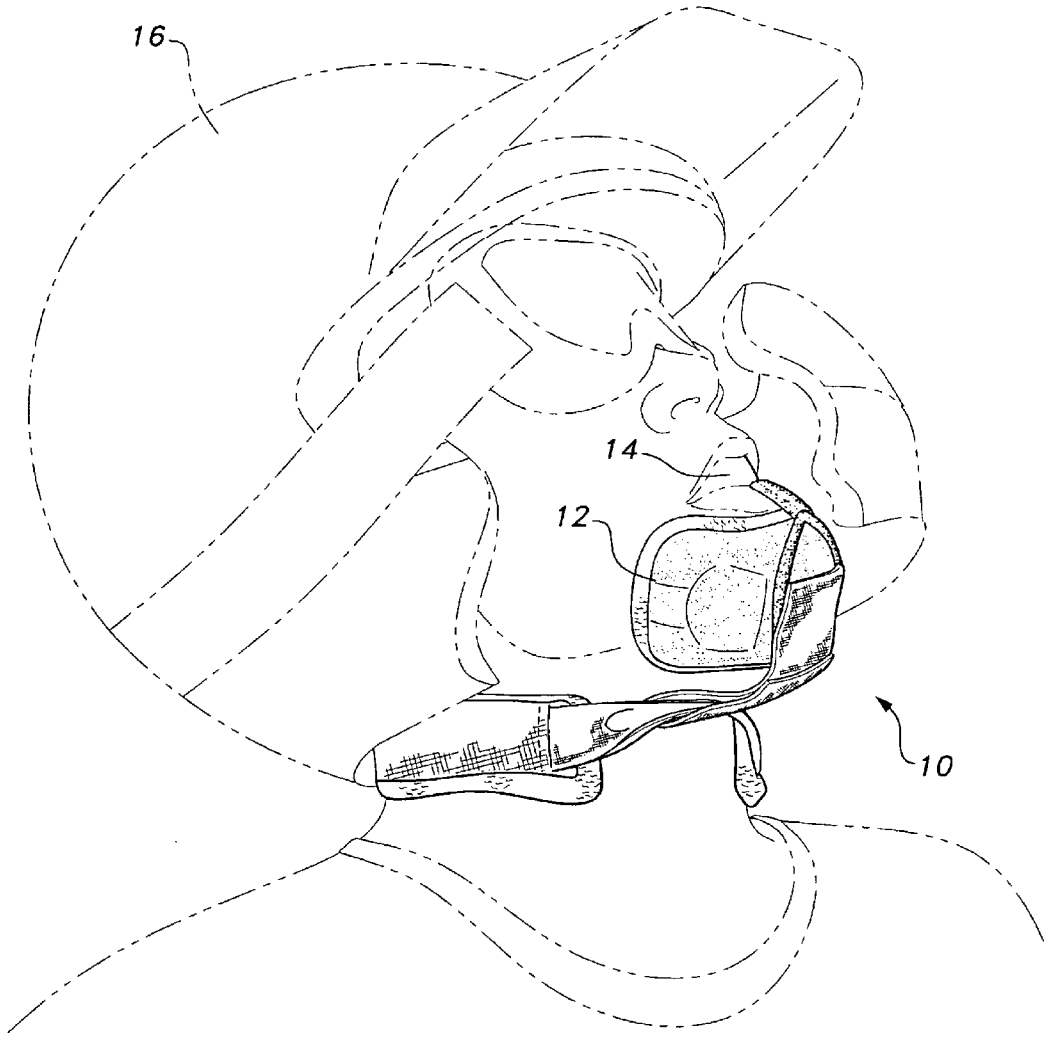
FIG. 1 is an environmental, perspective view of a combination chin protector and mouth guard according to the present invention.

The present invention is directed towards a combination chin protector and mouth guard 10, which is a device for protecting both the user's teeth and chin. As best shown in FIG. 1, the device 10 is particularly adapted for use in combination with a motorcycle or motocross helmet, such as exemplary helmet 16, though it should be understood that the combination chin protector and mouth guard 10 may be adapted for use with any activity or sporting equipment which requires the user to protect his or her face and teeth.

Figure 2:
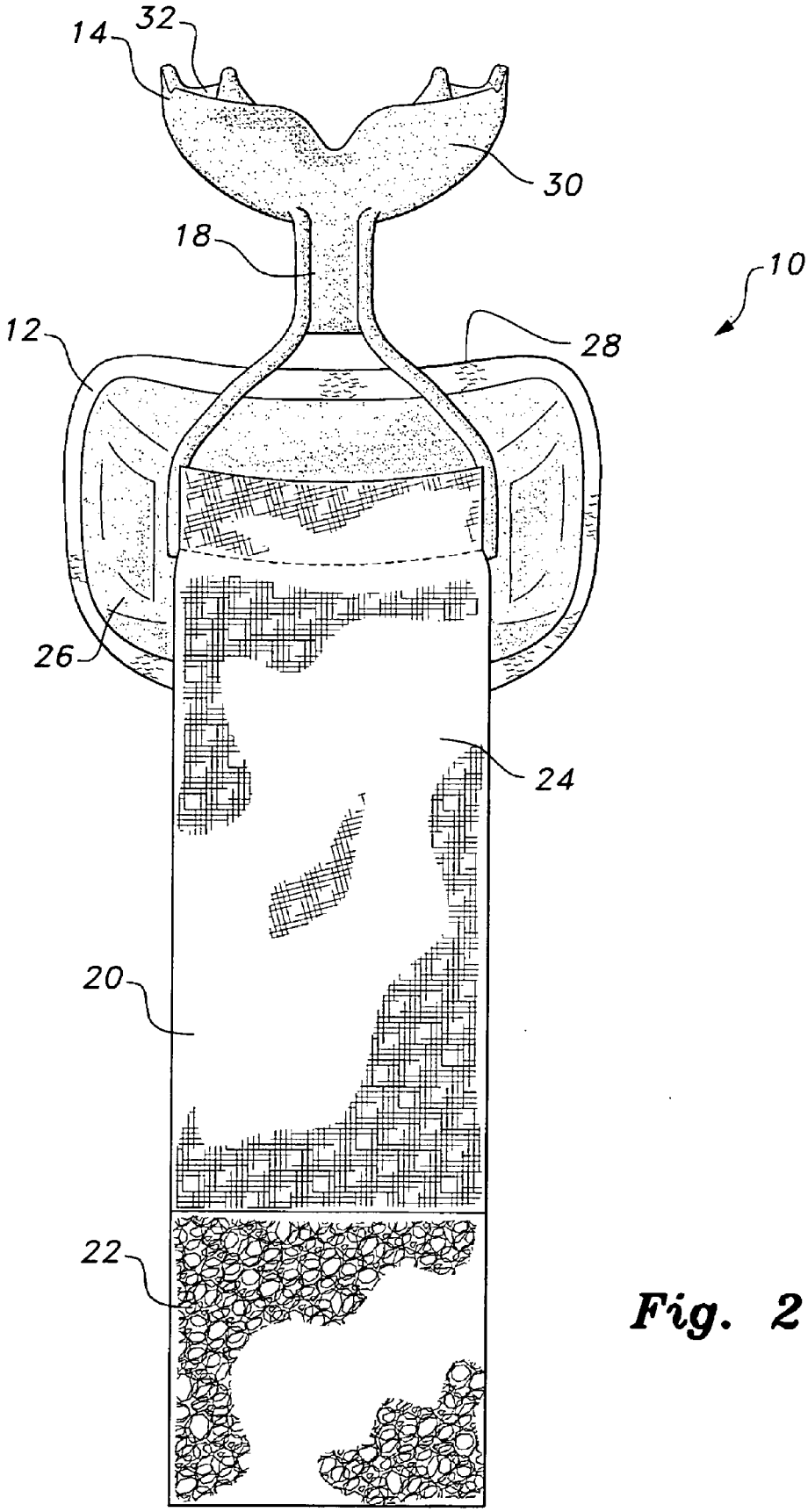
FIG. 2 is a perspective view of the combination chin protector and mouth guard according to the present invention.

As shown in FIG. 2, the combination chin protector and mouth guard 10 includes a chin protector 12 having opposed front and rear faces 26, 28, respectively, with the rear face 28 being concave and being contoured to receive and protect the chin of the user. Chin protectors are known in the art and chin protector 12 may be any suitable conventional chin protector. Chin protector 12 is preferably formed from a rugged material, such as plastic, which is capable of protecting the user's chin and jaw from injury due to accidental blows thereto, such as, for example, an accidental blow from a motorcycle handlebar.

A mouth guard 14, adapted for insertion into the mouth of the user, is further provided, with the mouth guard 14 having a front face 30 adapted for positioning against the lips of the user and at least one substantially U-shaped recess 32 being formed in the mouth guard to receive and protect the user's teeth. Mouth guards are known in the art and mouth guard 14 may be any suitable mouth guard. Mouth guard 14 is preferably formed from a rugged material, such as plastic, which is capable of protecting the user's teeth and tongue from injury due to accidental blows to the user's mouth, such as, for example, an accidental blow from a motorcycle handlebar. Mouth guards typically include either a single substantially U-shaped recess for receiving the user's upper teeth therein, or a pair of opposed U-shaped recesses for receiving both the user's upper and lower teeth therein. Mouth guard 14 may have either a single or a pair of recesses 32 for receiving the teeth of the user.

A support 18 having opposed upper and lower ends is further provided, with the upper end thereof being secured to the front face 30 of mouth guard 14, and the lower end thereof being secured to the front face 26 of chin protector 12 in order to tether the mouth guard 14 to the chin protector 12. The support 18 is preferably formed from a flexible material, such as flexible plastic. The support 18 is sized so as to comfortably extend between the user's chin and mouth.

Figure 3:
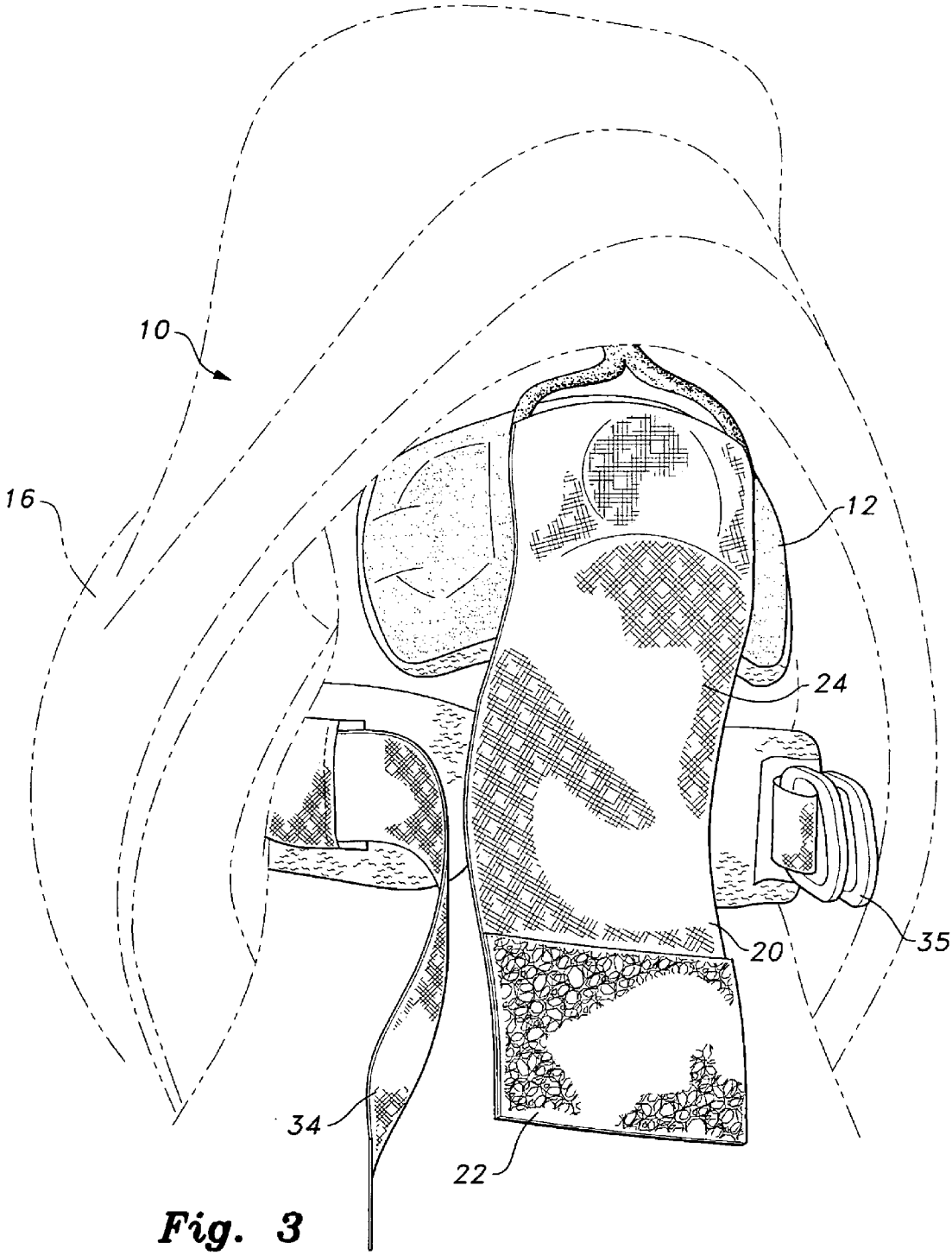
FIG. 3 is an environmental, perspective view of the combination chin protector and mouth guard according to the present invention, particularly illustrating the chin protector prior to securement thereof by a pair of helmet chin straps.
Figure 4:
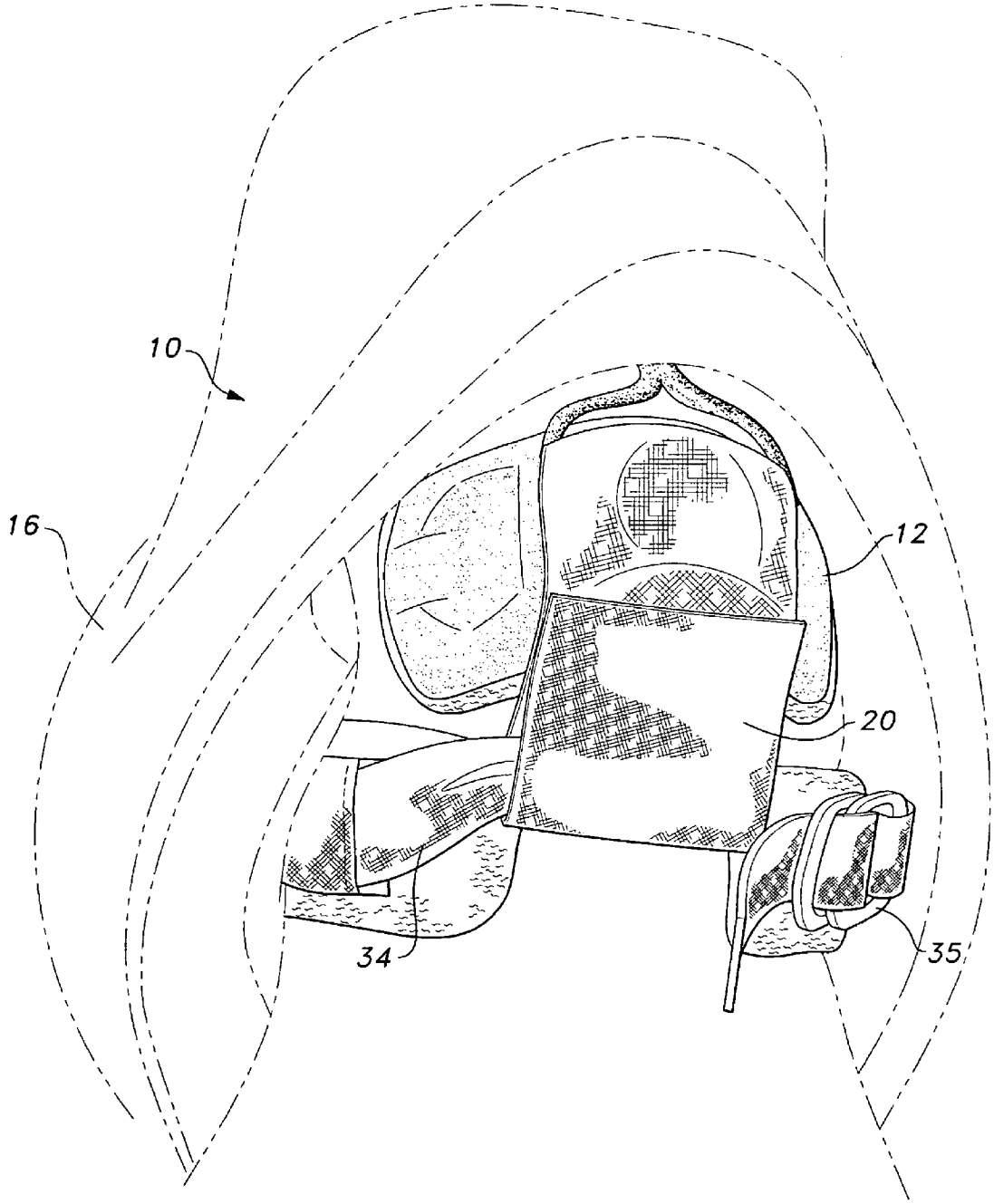
FIG. 4 is an environmental, perspective view of the combination chin protector and mouth guard according to the present invention.

The combination chin protector and mouth guard 10 further includes a strap 20 having opposed upper and lower ends, with the upper end of the strap being secured to the front face 26 of the chin protector 12. The strap 20 is adapted for securing at least one chin strap 34 (shown in FIG. 3 with complementary adjustment buckle 35) to the chin protector 12. The helmet chin strap 34 is used to secure the chin protector 12 to the user's chin, and to prevent accidental dislodgement of the device 10. A releasable fastener for releasably securing the upper end of the strap 20 to the lower end thereof is further provided in order to form a loop in the strap 20 such that the helmet chin strap 34 may be received and secured within the loop (shown in FIG. 4). The releasable fastener may be a hook and loop fastener 22, 24 or the like.

Figure 5A:
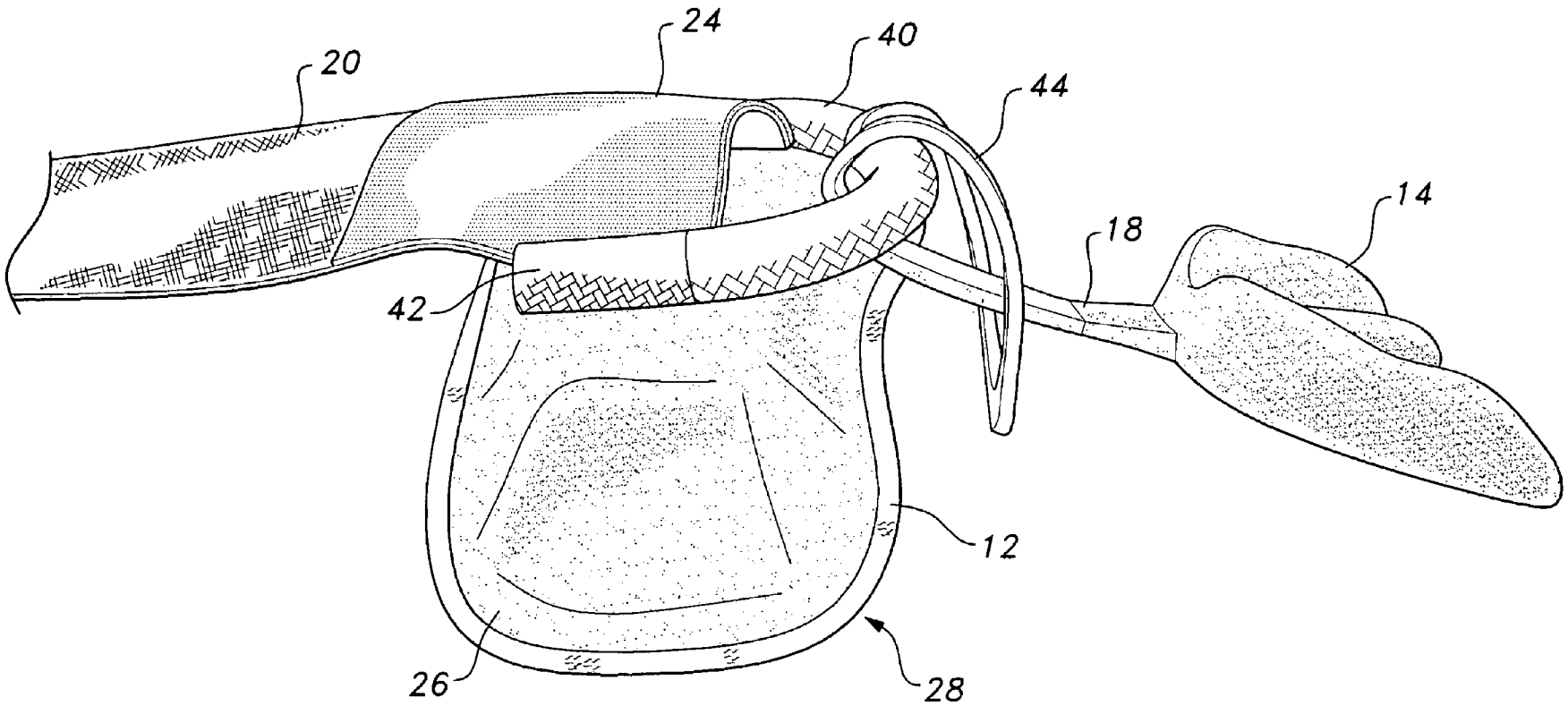
FIG. 5A is a side view of an alternative embodiment of a combination chin protector and mouth guard according to the present invention.
Figure 5B:
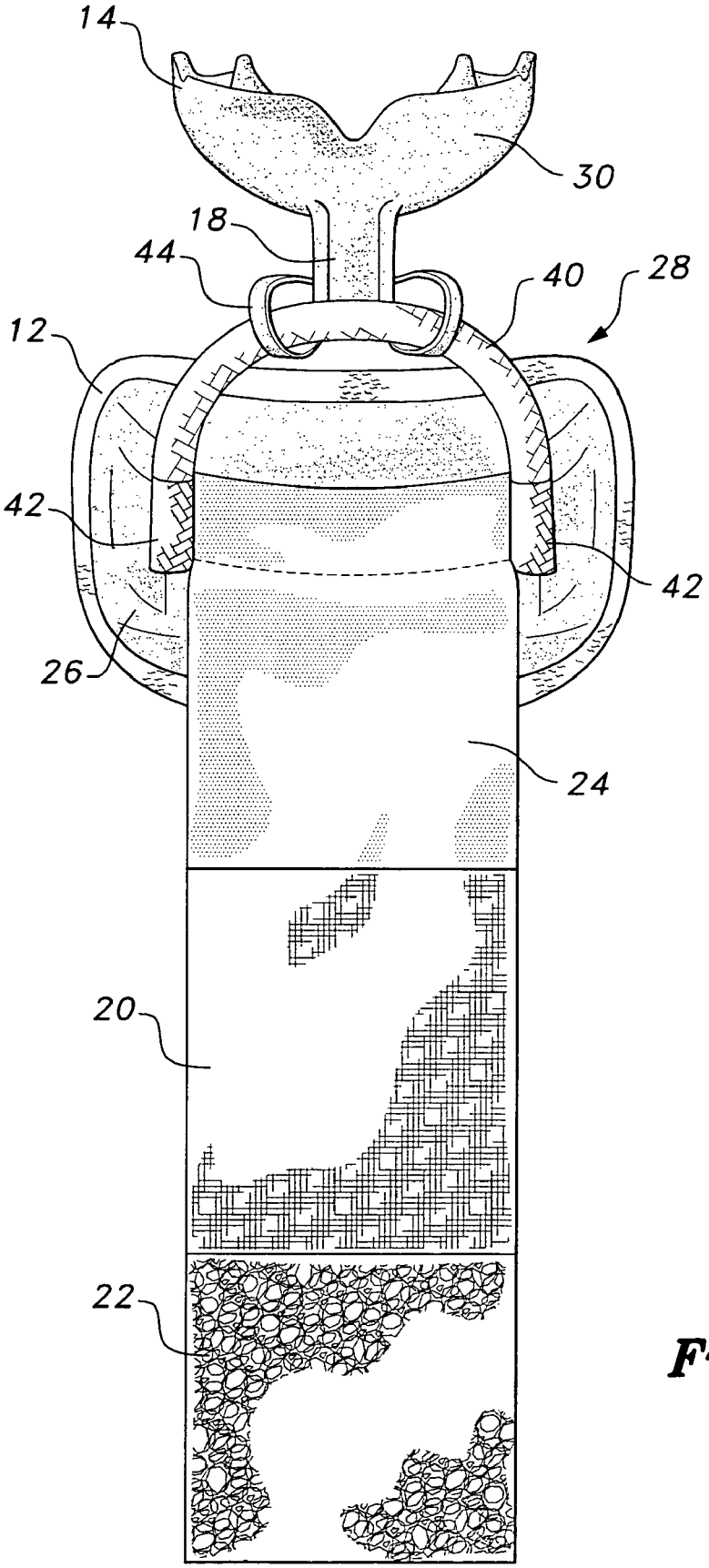
FIG. 5B is a top view of the combination chin protector and mouth guard of FIG. 5A.

In the alternative embodiment of FIGS. 5A and 5B, the support 18 terminates in loop 44. The loop 44 is wrapped around an elastic or resilient cord 40, which may be a segment of bungee cord or any other suitable type of elastic element, and which is secured at either end to the front face 26 of the chin protector 12. Preferably, the elastic cord 40 forms a substantially C-shaped loop, terminating in ends 42, which are secured to the front face 26 by stitching, adhesives or any other suitable form of attachment. The mouth guard 14 is inserted through the loop 44 after the loop 44 is wrapped around the cord 40 in order to secure the mouth guard 14 to the chin protector 12. The attachment of the loop 44 to the elastic cord 40 allows for elastic adjustment in the distance between the mouth guard 14 and the chin protector 12 when in use, as well as providing additional shock absorption for the user's jaw.

It is to be understood that the present invention is not limited to the embodiment described above, but encompasses any and all embodiments within the scope of the following claims.

I claim:

1. A combination chin protector and mouth guard, comprising:

a chin protector having opposed front and rear faces, opposed first and second ends, the rear face being concave and configured to receive and protect the chin of a user;

a mouth guard adapted for insertion into the mouth of the user, the mouth guard having at least one substantially U-shaped recess formed therein to receive and protect the user's teeth and a front face adapted for positioning against the lips of the user;

a strap having opposed upper and lower ends, the upper end of the strap being attached to the front face of said chin protector, the strap being adapted for securing at least one helmet chin strap to the chin protector;

an elastic member attached to the chin protector, wherein the elastic member is a substantially C-shaped loop having a pair of opposing ends attached to the front face of said chin protector and straddling the strap; and a support having opposed upper and lower ends, the upper end being attached to the mouth guard, the lower end terminating in a loop, the loop being wrapped around the C-shaped loop of the elastic member to elastically tether the mouth guard to the chin protector.

2. The combination chin protector and mouth guard as recited in claim 1, wherein the upper end of said support is attached to the front face of said mouth guard.

3. The combination chin protector and mouth guard as recited in claim 1, wherein the elastic member comprises a segment of bungee cord.

4. The combination chin protector and mouth guard as recited in claim 1, further comprising a releasable fastener for releasably securing the upper end of the strap to the lower end thereof to form a loop, the at least one helmet chin strap being received within the loop.

5. The combination chin protector and mouth guard as recited in claim 4, wherein the releasable fastener is a hook and loop fastener.

6. The combination chin protector and mouth guard as recited in claim 1, wherein the support is formed from a flexible material.

7. The combination chin protector and mouth guard as recited in claim 6, wherein the support is formed from plastic.

* * * * *